US011460202B2

(12) United States Patent
Powers

(10) Patent No.: US 11,460,202 B2
(45) Date of Patent: Oct. 4, 2022

(54) ROOF MOUNTED VENTILATION ASSEMBLY

(71) Applicant: Gary Gerard Powers, Shorewood, IL (US)

(72) Inventor: Gary Gerard Powers, Shorewood, IL (US)

( * ) Notice: Subject to any disclaimer, the term of this patent is extended or adjusted under 35 U.S.C. 154(b) by 0 days.

(21) Appl. No.: 15/929,392

(22) Filed: Apr. 30, 2020

(65) Prior Publication Data

US 2020/0348035 A1 Nov. 5, 2020

Related U.S. Application Data

(60) Provisional application No. 62/840,531, filed on Apr. 30, 2019.

(51) Int. Cl.
*F24F 7/02* (2006.01)
*F24F 7/08* (2006.01)

(52) U.S. Cl.
CPC ..... *F24F 7/025* (2013.01); *F24F 7/08* (2013.01)

(58) Field of Classification Search
CPC ..... F24F 7/025; F24F 7/08
See application file for complete search history.

(56) References Cited

U.S. PATENT DOCUMENTS 1,690,905 A * 11/1928 McDevitt ..... F24F 7/00 454/250
3,349,998 A * 10/1967 Stirling ..... F04D 25/166 415/143
3,791,279 A 2/1974 Holt et al.
4,043,777 A * 8/1977 Parren ..... F24F 7/025 62/259.4
4,373,509 A 2/1983 Neitzel et al.
4,467,782 A 8/1984 Russell
4,484,563 A 11/1984 Fritz et al.
4,562,955 A 1/1986 Horster et al.
4,744,409 A 5/1988 Berner
5,205,783 A 4/1993 Dieckert et al.
7,591,720 B2 9/2009 Kim et al.
8,795,040 B2 8/2014 Burdett et al.
9,062,892 B2 6/2015 Matsui
9,303,891 B2 4/2016 Takahashi et al.
10,094,587 B2 10/2018 Hasegawa et al.
2005/0287945 A1 12/2005 Choi et al.
2006/0174596 A1 8/2006 Choi et al.
2006/0270335 A1 11/2006 Kim et al.
2013/0013117 A1 1/2013 Desrochers
(Continued)

FOREIGN PATENT DOCUMENTS

CN 202993324 U * 6/2013
GB 2374661 A * 10/2002 ..... F24F 13/222

*Primary Examiner* — Jessica Yuen
(74) *Attorney, Agent, or Firm* — Dunlap Bennett & Ludwig, PLLC

(57) ABSTRACT

A roof mounted ventilation assembly having fluidly coupled supply and relief fans is provided. One drive unit assembly may be operatively associated with both fans. A rotatably and vertically movable duct fluidly couples a supply discharge plenum to a roof-mounted air intake hood so that the former may move vertically and rotatably relative to the latter, thereby the present invention can selectively pressurize the spaced inhabited by the supply discharge plenum through a positive supply to relief air volume ratio.

6 Claims, 4 Drawing Sheets

(56) References Cited

U.S. PATENT DOCUMENTS

| | | | | |
|---|---|---|---|---|
| 2013/0303074 | A1 | 11/2013 | Sakai et al. | |
| 2014/0260692 | A1 | 9/2014 | Sharp | |
| 2015/0064011 | A1* | 3/2015 | Xu | F04D 17/025 416/189 |
| 2015/0292761 | A1 | 10/2015 | Teoh | |

* cited by examiner

ROOF MOUNTED VENTILATION ASSEMBLY

CROSS-REFERENCE TO RELATED APPLICATION

This application claims the benefit of priority of U.S. provisional application No. 62/840,531, filed 30 Apr. 2019, the contents of which are herein incorporated by reference.

BACKGROUND OF THE INVENTION

The present invention relates to a roof mounted ventilation assembly and, more particularly, to a roof mounted ventilation assembly that includes supply and relief fans.

Most industrial ventilation consists of only relief fans which makes the space negative and dirty. Separate supply and relief fans are oversized, less efficient and the ratio of supply to relief air ratio can be difficult to maintain. Separate supply and relief fans can also be much less effective depending on where they are required to be located in relationship with each other. Separate supply and relief fans are more expensive to install. Negatively pressured spaces bring in dirty air and can draw in air from any location (including flue vents). Separate fans are typically over designed with too much air and they are typically not balanced properly or are never checked for air balance when started up. Separate supply and relief fans are not typically installed near each other. The effectiveness of moving air in low and out high (at the same location) is then typically lost. Separate supply and relief fans are more expensive to install with separate roof curbs, roof openings, structural supports, power feeds, motors, controllers etc.

As can be seen, there is a need for a roof mounted ventilation assembly that includes supply and relief fans. The assembly of the present invention assembly solves the following problems: sourcing and installing separate larger, inefficient supply and relief fans with separate control and air distribution components for industrial ventilation applications; relief only assemblies which depressurizes the space, draws dirty ambient air in from all openings (including such things as flue vents) and also leaves stagnant areas with no air movement; and recirculating contaminants from other roof equipment discharges and/or the swirl effect (eddies) of roof plumes from prevailing winds.

SUMMARY OF THE INVENTION

In one aspect of the present invention, a roof mounted ventilation assembly for a structure includes the following: an air inlet mounted to an upper portion of the structure; a supply discharge plenum fluidly coupled to the air inlet; the supply discharge plenum rotatably and vertically movable relative to the air inlet; and the supply discharge plenum disposed in an inner space defined by the structure.

In another aspect of the present invention, the roof mounted ventilation assembly for a structure includes the following: a relief blower fluidly coupled to the air inlet; and a drive assembly operatively associated with the relief blower and the supply discharge plenum in such a way that the drive assembly selectively pressurizes said inner space through a positive supply to relief air volume ratio; a hood operatively associated with the air inlet; and an air diffuser operatively associated with the supply discharge plenum in such a way that air diffusion is in a circular or rectangular pattern with four quadrants.

In yet another aspect of the present invention, a method of eliminating stagnate zones and negatively pressured spaces within a structure includes the following: providing at least one of the above-mentioned roof mounted ventilation assembly for a structure; selectively moving the supply discharge plenum at an elevation relative to the air inlet; selectively rotating the supply discharge plenum at a position relative to the inner space; and energizing the drive assembly in such a way that inner space has a positive supply to relief air volume ratio (or could be positive, neutral, or slightly negative by changing optional motorized damper actuators).

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a roof mounted ventilation assembly having fluidly coupled supply and relief fans. One drive unit assembly may be operatively associated with both fans. A rotatably and vertically movable duct fluidly coupling a supply discharge plenum to a roof-mounted air intake hood so that the former may move vertically and rotatably relative to the latter, thereby the present invention can pressurize the spaced inhabited by the supply discharge plenum through a positive supply to relief air volume ratio.

Figure 1:
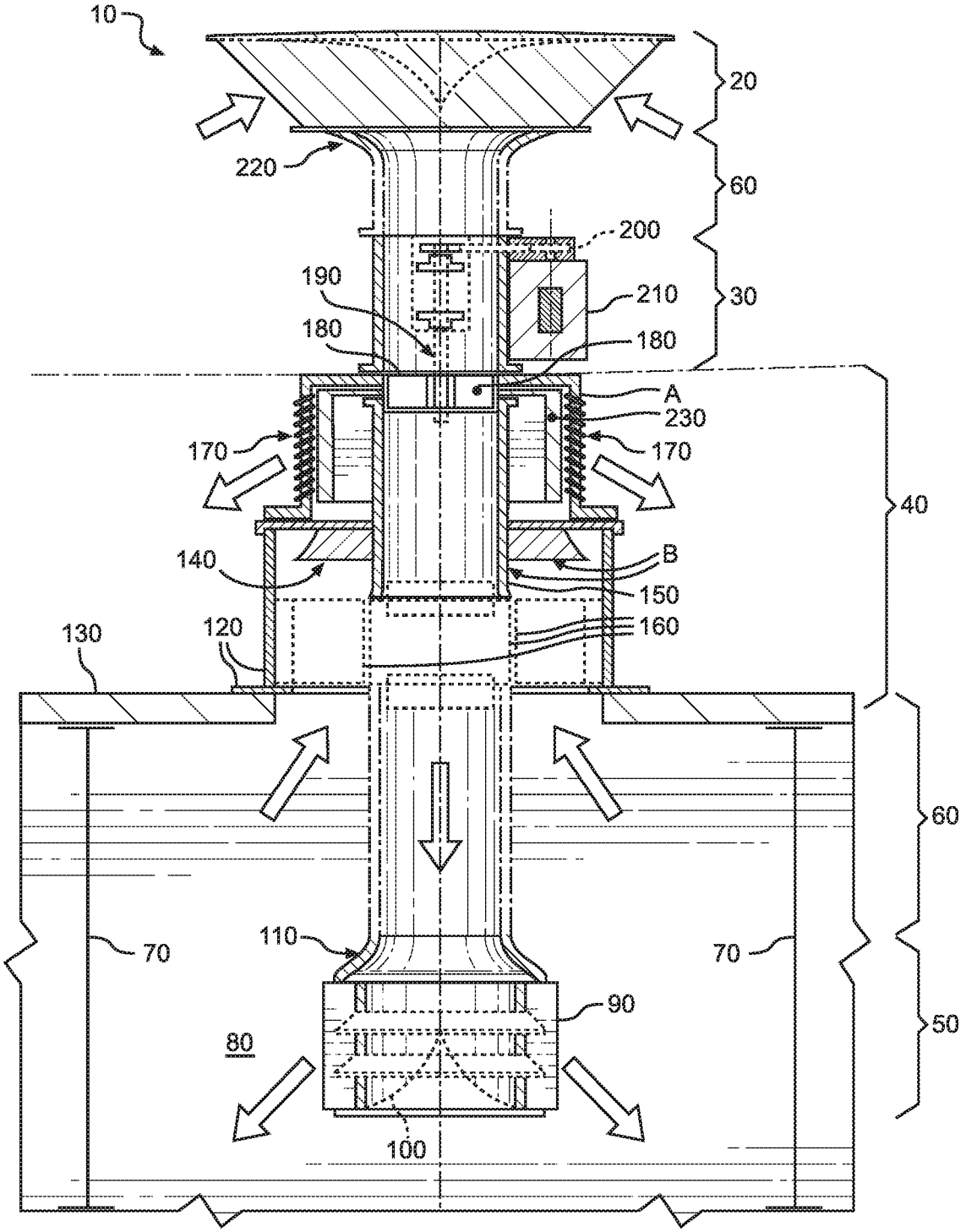
FIG. 1 is a front cross section view of an exemplary embodiment of the present invention.
Figure 2:
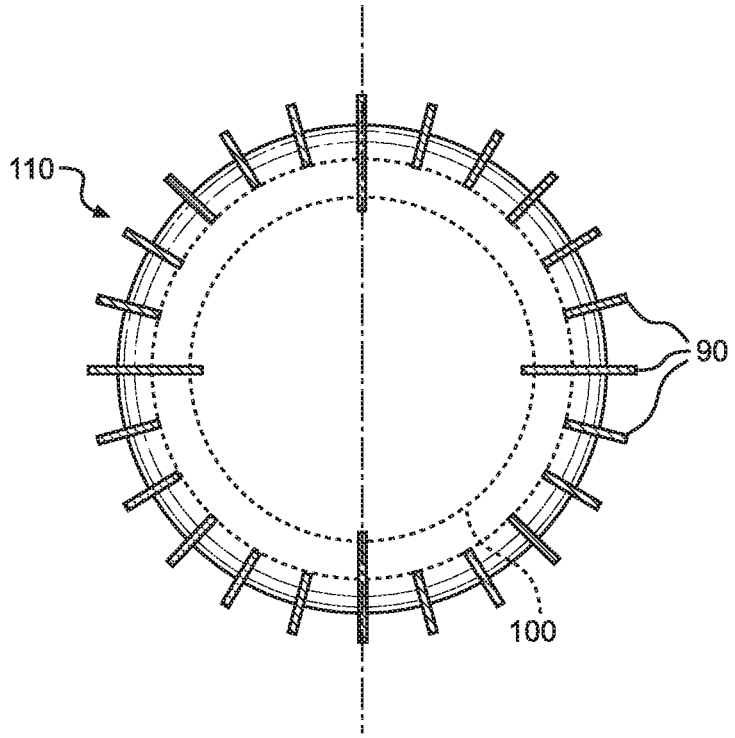
FIG. 2 is a top cross section view of an exemplary embodiment of a diffuser section the present invention, illustrating diffuser blades 90, round conical inlet collar 110 and conical bottom plate 100.
Figure 3:
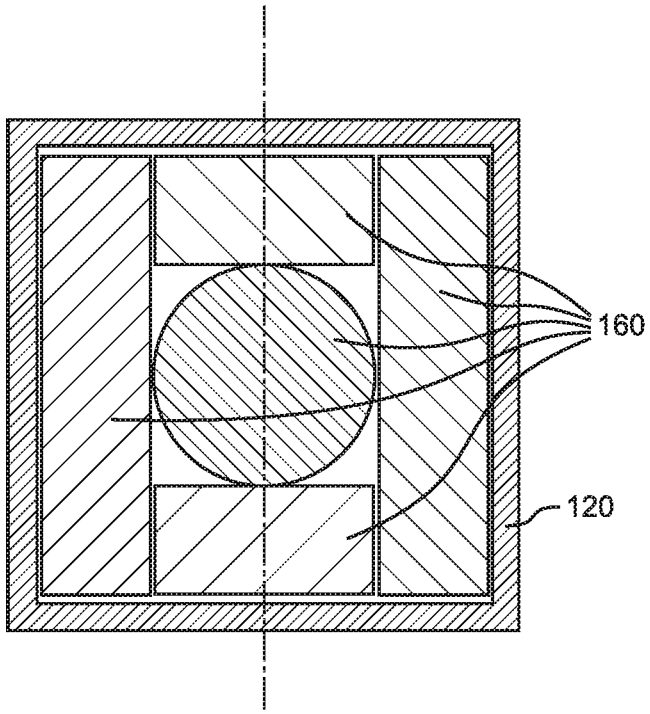
FIG. 3 is a top cross section view of an exemplary embodiment of a damper section of the present invention.
Figure 4:
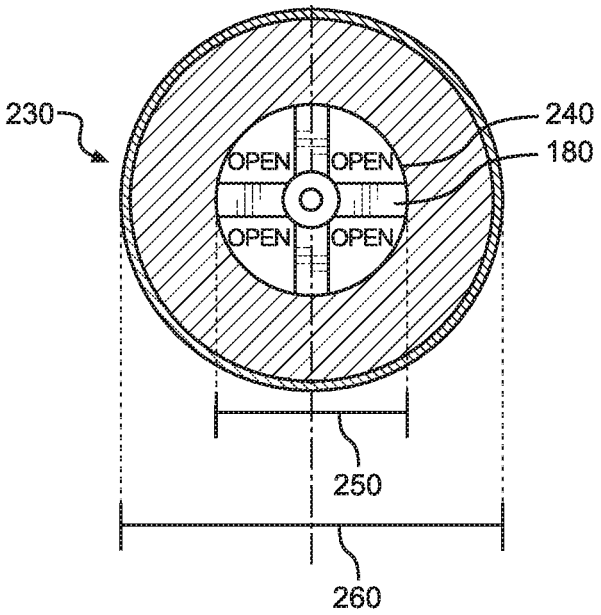
FIG. 4 is a top cross section view of an exemplary embodiment of a relief blower wheel 230 of the present invention, illustrating the fan blades 180 and air block 240 within an air block diameter 250 that is defined by a radius inlet cone having a relief blower wheel diameter 260.
Figure 5:
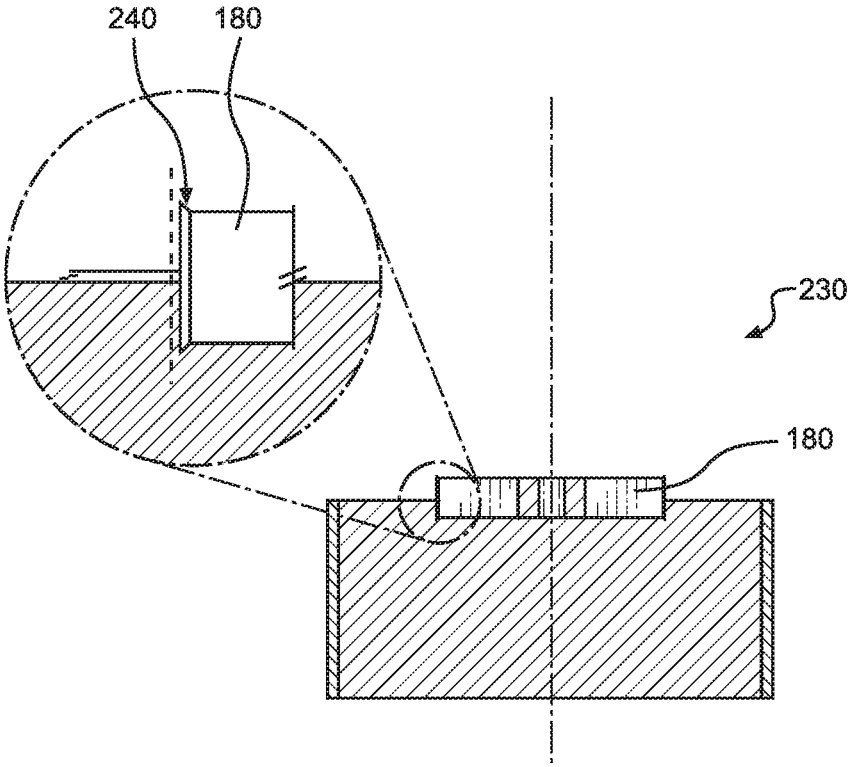
FIG. 5 is a detailed section view of an exemplary embodiment of a relief blower wheel/supply blades of the present invention.
Figure 6:
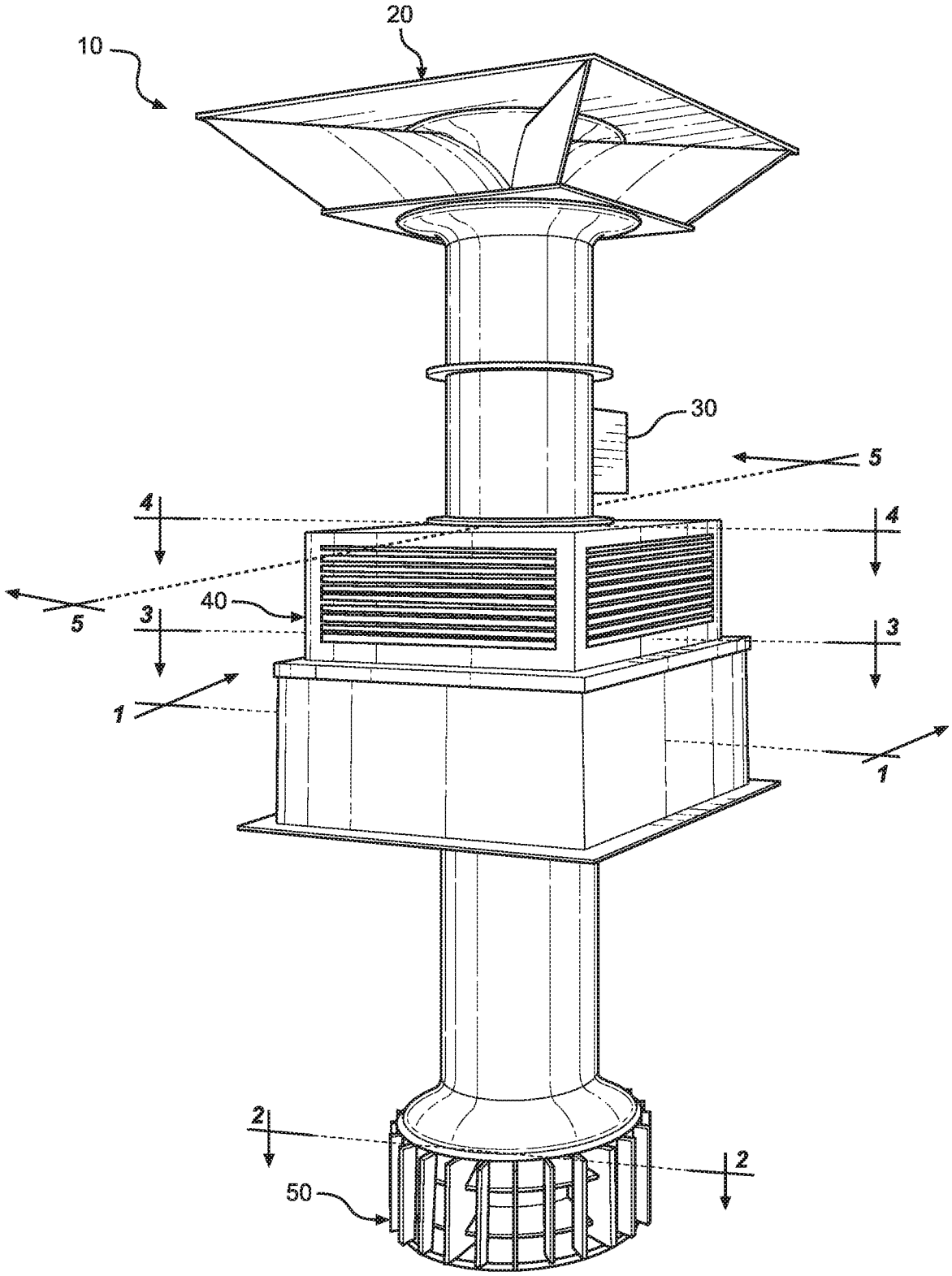
FIG. 6 is a perspective elevation view of an exemplary embodiment of the present invention.

Referring to FIGS. 1 through 6, the present invention may include a roof mounted industrial ventilation (RMIV) assembly 10. The present invention can combine both supply and relief air with one drive assembly. The assembly can also just be supply air only. By supplying air to the worker space as low as possible and also mechanically relieving air up high at the roof level, less total air is required to cool the space with ambient air. The assembly design also minimizes internal drag which reduces total break horsepower improving energy efficiency. The assembly may also have a variable frequency drive option for even more total energy savings.

The present invention pressurizes the space with a positive supply to relief air volume ratio. The filtered inlet option allows for the clean fresh air to the space for worker health and comfort. Pressurizing the space with multiple units eliminates stagnant zones. The round duct vertically movable filtered conical air inlet hood can intake air at whatever roof level is needed to avoid re-circulation of other roof discharge contaminants. The round duct vertically movable (and also rotatable) louvered register supply discharge plenum discharges at whatever level is needed and in whatever direction is needed allowing for maximized worker comfort.

The filtered intake assembly provides for a pressurized, clean, healthy and comfortable workspace. Combining supply and relief in one location and at the proper elevations allows for better efficiency, less total air flow and always positive ratio of supply to relief air. A combined assembly is less expensive to install than separate built up supply and relief fans.

Referring now to FIGS. 1 through 6, the present invention includes the following elements:

1. Air Inlet Hood: This is an air inlet adapted to draw in air with an inverted trapezoid prism shaped hood with a bird screen and optional filter with low drag design reducing fan brake horsepower. The basic model includes a wire mesh screen with options for multiple MERV level filers as the customer desires. The air inlet hood 20 may be fluidly connected to the remainder of the roof mounted industrial ventilation assembly 10 by way of a radius inlet cone 220.
2. Drive Unit: The drive unit to include the single motor and drive assembly powering the drive shafts for both the supply fan blade and the connected relief blower wheel 230. This may include an optional variable frequency drive motor and a control module. The control module may be a HONEYWELL SPYDER™ series (or equal) with control options to energize the assembly based on external inputs such as room temperature, humidity or room pressure. With optional motorized actuators, the shut off dampers 160 could be separately manipulated to change the ratio of supply to exhaust air as desired. The space could be positive, neutral, or slightly negative.
3. Relief Blower Assembly: The relief blower assembly directly connects to the drive unit and can come with an optional clutch to disengage the blower wheel from the drive shaft while the supply fan remains energized. The relief blower assembly 40 may include a conical inlet collar 140 and a B assembly 150 and relief louvers 170. Hot room air at the roof level may be mechanically drawn up into the blower wheel and pushed out through relief louvers.
4. Supply Discharge Plenum: The supply air plenum includes a round conical inlet with a round conical bottom pan. Air diffusion is in a circular or rectangular pattern with four quadrants. Horizontal diffusion may be from vertical blades around the circumference. Vertical diffusion may be from optional horizontal pitched rings. The low drag design reduces fan break horsepower.
5. Code Shut Off Dampers: Both the supply and the relief may have RUSKIN CD™ series (or equal) sealed shut off dampers.
6. Round Duct: The inlet hood and the supply discharge plenum may be connected by the installing contractor in the field with round spiral type duct MCGILL™ (or equal).

The drive unit 30 may be a motor 210 powered fan blade drive assembly that draws air in through the conical air inlet hood 20. The fan blade drive assembly may include a drive assembly belt 200. The drive unit 30 may be a belt drive unit, a direct drive unit, and may include optional variable frequency drive motor. The drive unit 30 connects to conical air inlet hood 20 with field installed round duct 60. Drive unit 30 may directly connect to the relief blower assembly 40 by way of a shaft 190, and also drives the relief blower wheel 230. Relief blower assembly 40 connects to the supply discharge plenum 50 with field installed round duct 60. Field installed code shut off dampers 160 may be in place to shut when the unit is de-energized per International Mechanical Code Requirements.

The RMIV assembly 10 may be mostly welded steel and aluminum construction. There are screws, filter clips, nuts and bolts for some components. The main components may be factory built. The RMIV assembly 10 may then be constructed in the field as noted below: Field installation is very similar to most existing packaged rooftop fan assemblies. In that regard, the RMIV assembly 10 may be installed in the field (at the industrial facility) mostly by a qualified mechanical contractor. Installation may also include crane, electrical, controls, steel and roofing contractors. A curb may be installed over the appropriate size roof opening. The relief shut off dampers 160 may be set on a tray inside the roof curb 120. (Depending on the type of existing roof deck 130, the roof opening and roof structure 70 may have to be re-enforced to accept the new unit.) The relief blower assembly 40 may then be placed on the roof deck 130. The drive unit 30 may be then connected to the relief blower assembly 40. The air inlet hood 20 may then set at the desired elevation with field supplied round spiral duct. (Depending on local code and/or the desired height, guide wires may need to be connected to stabilize the unit.) Finally, inside the space 80, the supply discharge plenum 50 may be set at the desired elevation (and/or rotation) with field supplied spiral duct.

The combination supply and relief fan assembly(s) are placed as needed in industrial facilities (and/or warehouses) to improve comfort and air quality for the cooling season. The one or more RMIV assemblies 10 replaces existing exhaust fans meant for cooling season comfort ventilation. The one or more RMIV assemblies 10 provides clean filtered air to the structure's interior space 80. The positive supply to relief air volume ratio remains constant at all speeds keeping the space pressurized and thereby keeping contaminants out. Constant positive space pressure keeps such items as flue vents pushing out and not recirculating back into the space.

The field supplied round spiral duct may be custom fit to place the inlet hood and supply discharge plenum as needed at any given location in an industrial facility. Also, the inlet hood 20 and the supply discharge plenum 50 can be moved up and down (relatively easily) while the base unit remains connected if field conditions change. The variable speed drive unit 30 allows the supply to relief air volume to adjust up and down in the same proportion keeping the space positive.

The present invention may further include an assembly controller that has options to energize the assembly based on external inputs such as room temperature, humidity or room pressure. With optional motorized actuators, the shut off dampers 160 could be separately manipulated to change the ratio of supply to exhaust air as desired. The space could be positive, neutral, or slightly negative.

The present invention may come with a built-in inlet bird screen. However, inlet filters and/or the filter type (i.e. the filter MERV rating) are optional. The motor type (i.e. open drip proof, totally enclosed, starter or VFD drive) is optional. The controls may be either simple on/off or variable speed with a user interface on the interior of the building or there may be an option for BacNET control via a building automation system. With optional motorized actuators, the shut off dampers 160 could be separately manipulated to change the ratio of supply to exhaust air as desired. The space could be positive, neutral, or slightly negative. The code shut off damper type at the roof level may be optional based on local code. The discharge registers type may also be optional.

The concept could be used for other process or modular room applications where the total air volume may be required to change but the supply to relief air volume needs to remain positive keeping the space positive. A direct fired heating option can be added in the supply neck between component 20 (Conical Air Inlet Hood) and drive unit component 30 to convert this into a direct fired heating unit. The heating unit may be bolted on and is similar to a CAPTIVE AIRE™ or POWER FLAME™ equivalent direct fired burner heating unit.

It should be understood, of course, that the foregoing relates to exemplary embodiments of the invention and that modifications may be made without departing from the spirit and scope of the invention as set forth in the following claims.

What is claimed is:

1. A roof mounted ventilation assembly for a structure, comprising:

a relief blower assembly mounted to an upper portion of the structure;

an air inlet movably disposed above and relative to the relief blower assembly;

a supply discharge plenum fluidly coupled to the air inlet by way of a supply conduit;

the supply discharge plenum rotatably and vertically movable relative to the relief blower assembly;

the supply discharge plenum disposed in an inner space defined by the structure, the inner space downward of said upper portion;

the relief blower assembly comprising a relief blower wheel integrated with a supply fan, wherein the supply fan is fluidly coupled to the supply conduit, and wherein the relief blower wheel comprising a plurality of centrifugal fan blades;

the plurality of centrifugal fan blades is coupled to the inner space by way of a relief inlet, and wherein the plurality of centrifugal fan blades is fluidly coupled to an external environment by way of a relief louver, wherein the plurality of centrifugal fan blades is configured to urge interior air from the inner space to the external environment through the relief louver disposed below the supply fan; and a drive assembly operatively associated with the relief blower assembly in such a way that the selectively pressurizes said inner space through a positive supply air to relief air volume ratio, whereby the supply fan draws in the supply air from the air inlet and the relief blower wheel exhausts the relief air from the relief blower assembly.

2. The roof mounted ventilation assembly for a structure of claim 1, wherein the drive assembly is a motor.

3. The roof mounted ventilation assembly for a structure of claim 1, comprising:

a hood operatively associated with the air inlet; and the hood having an inverted trapezoid prism shaped hood with a bird screen and optional filter.

4. The roof mounted ventilation assembly for a structure of claim 1, comprising:

an air diffuser operatively associated with the supply discharge plenum in such a way that air diffusion is in a circular or rectangular pattern with four quadrants.

5. A method of eliminating stagnate zones and negatively pressured spaces within a structure, comprising:

providing at least one roof mounted ventilation assembly for a structure of claim 2;

selectively moving the supply discharge plenum at a first elevation relative to the relief blower assembly;

selectively moving the air inlet at a second elevation relative to the relief blower assembly;

selectively rotating the supply discharge plenum at a position relative to the inner space; and energizing the drive assembly in such a way that inner space has a positive supply to relief air volume ratio or could be positive, neutral, or slightly negative by changing optional motorized damper actuators.

6. A roof mounted ventilation assembly for a structure, comprising:

a relief blower assembly mounted to an upper portion of the structure;

an air inlet disposed above the relief blower assembly;

a supply discharge plenum fluidly coupled to the air inlet;

the supply discharge plenum disposed in an inner space defined by the structure;

the relief blower assembly comprising a relief blower wheel integrated with an axial supply fan, wherein the axial supply fan fluidly couples the air inlet and the inner space, and wherein the relief blower wheel comprising a plurality of centrifugal fan blades;

the plurality of centrifugal fan blades is fluidly coupled to the inner space by way of a relief inlet, wherein the plurality of centrifugal fan blades is fluidly coupled to an external environment by way of a relief louver disposed below the axial supply fan, and wherein the plurality of centrifugal fan blades is configured to urge air from the inner space to the external environment; and a drive assembly operatively associated with the relief blower assembly in such a way that the selectively pressurizes said inner space through a positive supply air to relief air volume ratio.

* * * * *